US008235210B2

(12) United States Patent
De Lacerda et al.

(10) Patent No.: US 8,235,210 B2
(45) Date of Patent: Aug. 7, 2012

(54) WELDING WIRE CONTAINER COVER AND CONTAINER CONTAINING SAME

(75) Inventors: Antonio Carreto De Lacerda, Agualva-Cacem (PT); Ines Pignatelli, Alges (PT); Hendrik Perrée, Barcelona (ES)

(73) Assignee: Lincoln Global, Inc., City of Industry, CA (US)

( * ) Notice: Subject to any disclaimer, the term of this patent is extended or adjusted under 35 U.S.C. 154(b) by 624 days.

(21) Appl. No.: 12/430,476

(22) Filed: Apr. 27, 2009

(65) Prior Publication Data

US 2010/0270307 A1 Oct. 28, 2010

(51) Int. Cl.
*B65D 85/04* (2006.01)
*B65H 18/28* (2006.01)

(52) U.S. Cl. ..... 206/393; 206/407; 206/409; 242/160.2; 242/170; 242/172

(58) Field of Classification Search ..... 220/212, 220/DIG. 13, 229, 220, 254; 206/393, 407, 206/409, 392, 408; 222/460, 321.1, 566, 222/571, 109, 553, 562; 242/128, 129, 159, 242/171, 402, 409, 172, 170, 160.2; 221/13, 221/30, 63, 67, 68, 55
See application file for complete search history.

(56) References Cited

U.S. PATENT DOCUMENTS

| | | | | |
|---|---|---|---|---|
| 2,027,670 | A * | 1/1936 | Broeren | 221/55 |
| 2,027,674 | A * | 1/1936 | Broeren | 221/55 |
| 3,352,412 | A | 11/1967 | Draving et al. | |
| 4,097,004 | A * | 6/1978 | Reese | 242/129.72 |
| 5,494,160 | A | 2/1996 | Gelmetti | |
| 6,715,608 | B1 * | 4/2004 | Moore | 206/397 |
| 6,938,767 | B2 | 9/2005 | Gelmetti | |
| 7,441,657 | B2 | 10/2008 | Gelmetti | |

FOREIGN PATENT DOCUMENTS

WO 2005/061168 A1 7/2005

* cited by examiner

*Primary Examiner* — Mickey Yu
*Assistant Examiner* — Chun Cheung
(74) *Attorney, Agent, or Firm* — Perkins Coie LLP

(57) ABSTRACT

The present invention provides a welding wire container lid contains a surface portion, a vertical portion extending downward from the surface portion at an end of the surface portion, a protrusion portion extending upward from the surface portion, and an elongated opening which extends from the protrusion portion onto the surface portion near the vertical portion. The opening has two sides opposite each other, where a first of the sides follows a contour of the surface portion and the protrusion portion and a second of the sides has a contour which is different from the contour of the first side.

19 Claims, 4 Drawing Sheets

WELDING WIRE CONTAINER COVER AND CONTAINER CONTAINING SAME

FIELD OF THE INVENTION

Embodiments of the present invention relate to a cover for a bulk welding wire container and to a bulk welding wire container employing the same.

BACKGROUND OF THE INVENTION

Welding operations are in the trend of being automated, such as with robotic welding, where a robotic welding unit continuously performs a repeated or a series of repeated welding operations. In such an application it is necessary for the welding wire/electrode to be continuously supplied so that the welding operation is not stopped to reload an additional supply of welding wire.

Thus, large bulk wire welding containers have been developed and provided which contain a large length of wire. For example 500 feet of wire can be provided in a coiled fashion within the container. In such a container the wire is drawn out through an opening in a lid of the container, where the lid often functions to hold coils of the wire within the container to prevent the wire from unwinding out of the top of the container. Even though the length of the wire is large, as with all things, it will eventually run out requiring replacement. The replacement of the container causes down time in which welding does not occur. Additionally, depending on the construction of the lid as the wire is drawn out of the container the wire can bind or tend to get snagged, thus stopping the welding operation.

In an effort to deal with the container replacement issue discussed above, systems have been developed which allow the tail end of a welding electrode from a first container to be secured to the beginning end of a welding electrode from a second container to allow for further continuous welding. However, there are issues with these systems in that they may not provide for ease of drawing out of the wire during operation and/or they may not provide sufficient stability or security to the end portion of the wire to allow property security of the end portion to the beginning portion of a next container.

Therefore, a need exists to provide a welding container lid and a container containing the lid which allows for the easy payout of the wire and proper security to an end portion of the wire in a container.

BRIEF DESCRIPTION OF THE INVENTION

In an embodiment of the invention, a welding wire container lid contains a surface portion, a vertical portion extending downward from the surface portion at an end of the surface portion, a protrusion portion extending upward from the surface portion, and an elongated opening which extends from the protrusion portion onto the surface portion near the vertical portion. The opening has two sides opposite each other, where a first of the sides follows a contour of the surface portion and the protrusion portion and a second of the sides has a contour which is different from the contour of the first side.

BRIEF DESCRIPTION OF THE DRAWINGS

The advantages, nature and various additional features of the invention will appear more fully upon consideration of the illustrative embodiments of the invention, which are schematically set forth in the figures, in which.

DETAILED DESCRIPTION OF EXEMPLARY EMBODIMENTS OF THE INVENTION

Figure 1:
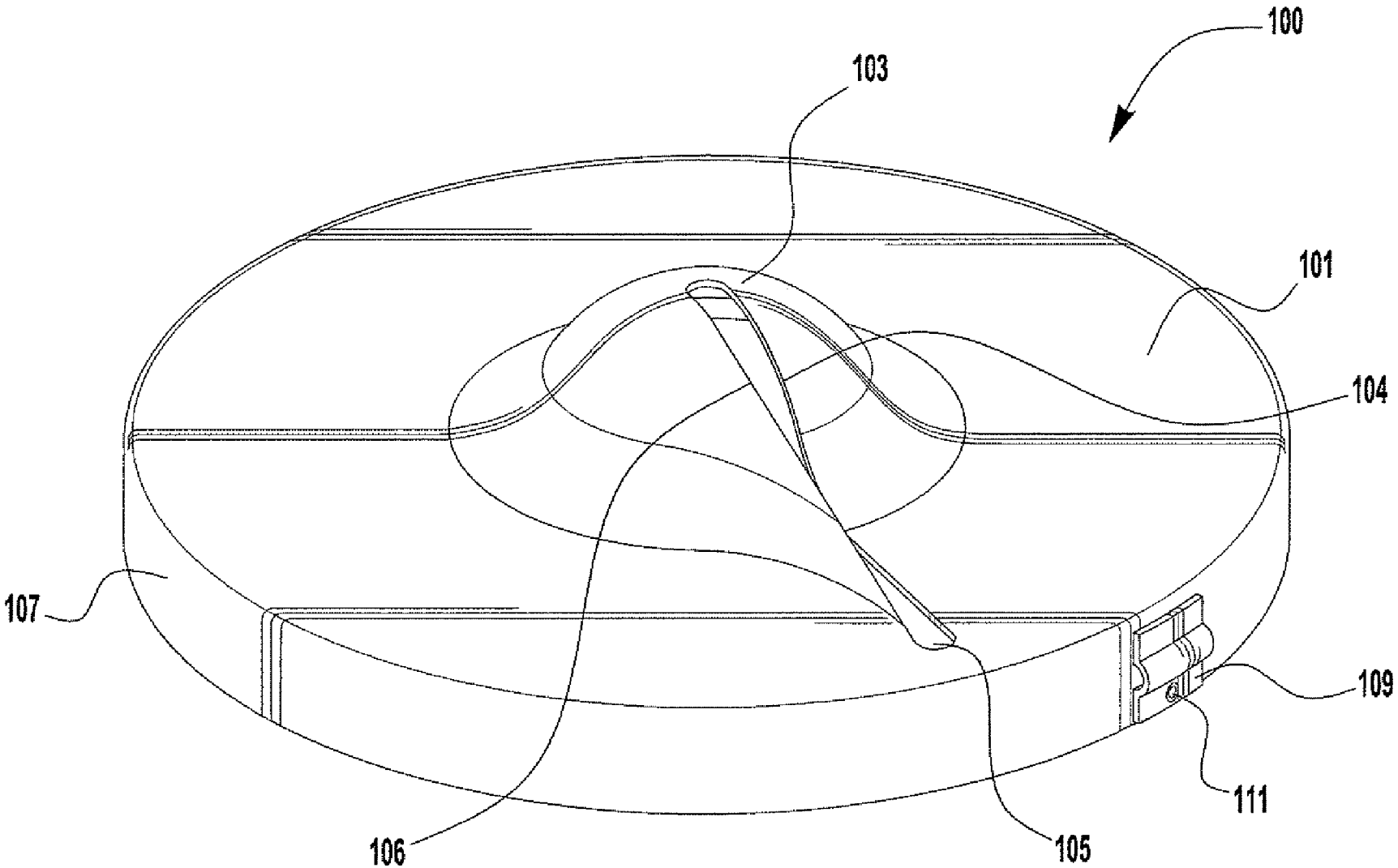
FIG. 1 is a diagrammatical representation of an asymmetric view of a container lid in accordance with an exemplary embodiment of the present invention.

While various embodiments of the present invention will be illustrated with reference to particular embodiments as discussed below, it should be understood that other embodiments of the present invention can be implemented with other devices and structure than that specifically described and shown herein, and that the present invention is not intended to be limited to the specific embodiments shown and described herein. Further, like reference numerals designate like parts throughout the FIGURES.

Figure 2:
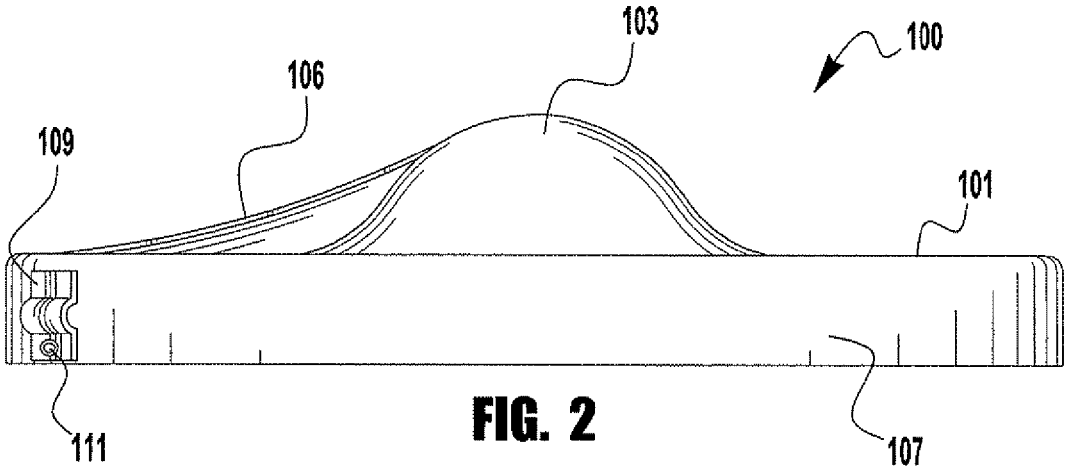
FIG. 2 is a diagrammatical representation of a side view of the embodiment shown in FIG. 1.
Figure 3:
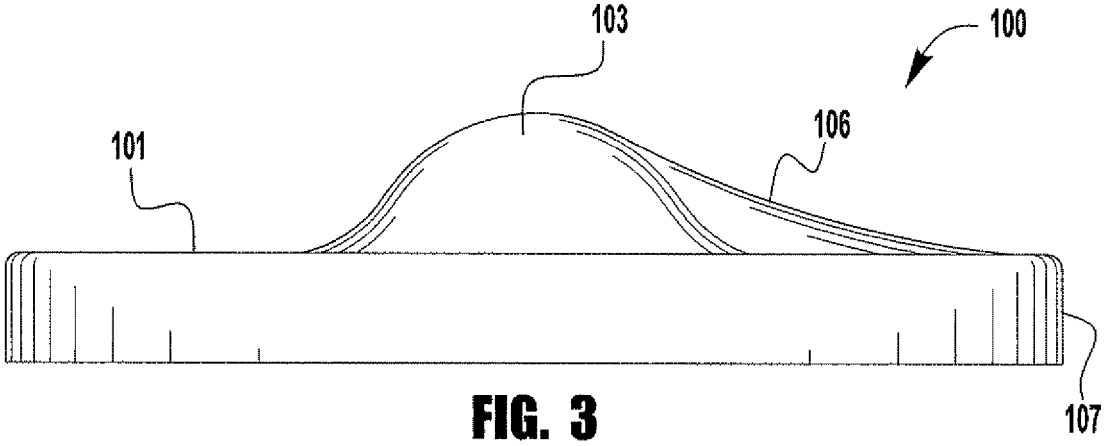
FIG. 3 is a diagrammatical representation of another side view of the embodiment shown in FIG. 1.

FIGS. 1, 2 and 3 show a container lid 100 in accordance with an exemplary embodiment of the present invention. The lid 100 is designed to fit on top of a bulk welding electrode (or "wire") container, and can be removable such that the lid 100 can be easily moved from one container to another. The lid 100 can be made of any number of materials including metal, hard plastic etc., and can be manufactured as a single integrated structure—such as by pressing a metal or injection molding—or the lid 100 can be made up of a number of distinct components that are secured to each other by various known means.

It is noted that the FIGs. depict the lid 100 has having a generally circular shape so as to match a circular container for the bulk wire (not shown). However, the present invention is not limited in this regard, and the lid 100 can have any general shape required so as to be properly secured to a wire container, such as square, rectangular, etc.

The lid 100 contains a surface portion 101, which can be generally flat, and vertical rim portion 107 (which is generally vertical relative to the surface portion 101) and a protrusion portion 103, that extends normally with respect to the surface portion 101. The protrusion portion has a generally circular cross section when viewed at the surface portion 101 and a generally smooth arcuate shape when viewed from the side (see e.g., FIGS. 1-3). By having such a shape, the protrusion portion 103 does not have any sharp edges or corners which would cause the wire to bind or be caught as the wire is being drawn out of a container.

Extending from a peak of the protrusion portion 103 to near the vertical portion 107 is an opening 105 having an elongated shape. The opening 105 is shown having generally oval shape, however, the present invention is not limited in this regard. Further, in other exemplary embodiments it is not necessary for the opening 105 to stop at the peak of the protrusion 103, as the opening 105 may extend past the peak or stop short of the peak. Moreover, the overall shape and size of the opening 105 should be such that the wire within the container can easily be drawn out of the container while at the same time providing protection to the wire from debris, etc. Further, in exemplary embodiments of the present invention, corners of the opening 105 generally have a radius such that no damage from corners occurs to the wire as it is being drawn out.

As shown in FIG. 1, the opening has two longitudinal sides 104/106 which run from one end of the opening to the other, where these sides aid in defining the opening 105. In the depicted embodiment, the sides 104/106 are equidistant from each other across the opening, when looking down vertically at the lid 100. However, in other embodiments the sides may not be equidistant at portions of the opening 105.

In the embodiment shown in FIGS. 1-3, one side 104 follows the general contour of the lid 100 from one end of the opening to the other, and the other side 106 does not follow the contour of the lid 100 and does not follow the contour of the other side 104. That is, from a side view of the lid 100 the side 104 would not be visible, while the opposite side 106 would be visible above the contour of the lid 100. This is clearly depicted in FIGS. 2 and 3, in which the side 106 is clearly visible above the contour of the lid 100. That is, the contour of one side 104 of the opening does not match the contour of the opposite side 106 of the opening 105.

By having this configuration it is easier to draw the wire through the opening 105 and out of the container (not shown). Specifically, having this raised side 106 aids in guiding the wire, being drawn out of the container, out of the opening 105 and reduces the probability of binding or catching the wire through the opening. This is particularly true in instances where the wire has unwound within the container such that coils of the wire are at or near the bottom surface of the lid 100. In this situation, the raised side 106 allows for a gradual angling of the wire out of the lid 100 to allow it to pass through the opening 105 without binding, rather than a more abrupt or sharp bend as when the sides 104/106 have the same shape.

In the exemplary embodiment shown in FIGS. 1-3 the side 106 has a shape which extends from the protrusion 103 to the end of the opening 105 adjacent the vertical portion 105. Further, in the depicted embodiment the shape of the side 106 has a slight concave curvature. However, in another exemplary embodiment, the side 106 is a substantially straight line from the protrusion portion 103 to the end of the opening 105 adjacent the vertical portion 107. In yet a further exemplary embodiment, the side 106 has a convex shape. The shape of the side 106 is to be selected to optimize the performance of the wire payout method.

The side 106 of the opening 105 which is to be raised with respect to the contour of the lid 100 is to be chosen based on the coiling and payout direction of the wire. That is, the raised side 106 is to be the side to allow for the smooth payout of the wire based on the coiling direction of the wire.

In another exemplary embodiment of the present invention, the side 104 of the opening opposite the raised side 106, can be extended down with respect to the contour of the lid 100. This embodiment is not expressly shown in FIG. 1. In this embodiment, similar to the raised side 106 the opposite side 104 does not follow the contour of the lid, but extends down (such that it would be extending towards the container/wire) in a similar fashion as the side 106. In this embodiment, the side 104 that extends down provides for the additional smooth transition of the wire through the opening as the wire is drawn through the opening.

In yet a further exemplary embodiment, it is contemplated that rather than extending outward with respect to the lid 100 (as shown in FIGS. 1-3) one of the sides 104/106 extends inward with respect to the lid 100 in a similar fashion as described above. For example, the side 106 can match the contour of the lid 100 (similar to side 104 in FIGS. 1-3) while the side 104 extends inward with respect to the lid 100. Such an embodiment will also allow for the enhanced payout of the wire through the opening while minimizing the chance for binding, etc. as the wire is drawn through.

Figure 4:
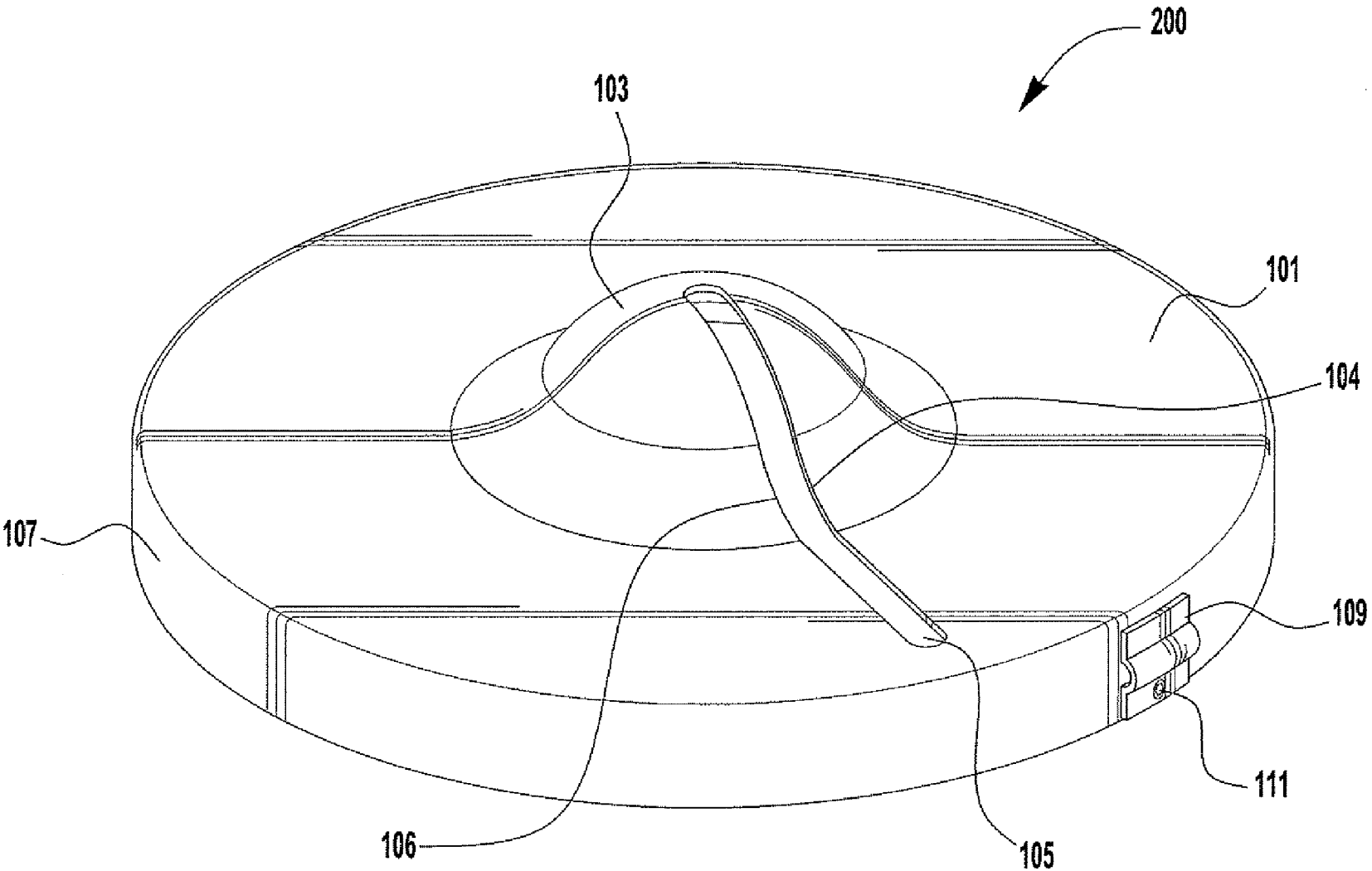
FIG. 4 is a diagrammatical representation of an asymmetric view of a container lid in accordance with another exemplary embodiment of the present invention.

FIG. 4 depicts another exemplary embodiment of a lid 200 in accordance with an exemplary embodiment of the present invention. However, in this embodiment the sides 104 and 106 follow the same contour.

Turning now to yet another aspect of the present invention, as shown in each of FIGS. 1, 2, and 4 a wire retaining member 109 is secured to the vertical portion 107 of the lid 100. The wire retaining member 109 is employed to fixedly secure an end of the wire bundle to the lid 100 such that the wire is generally not movable with respect to the lid 100 except for passing through the retaining member 109 between the member 109 and the vertical portion 107 of the lid 100. That is, the retaining member 109 is of a shape and construction to secure the wire adjacent to the vertical portion 107 such that the wire can not slip out from under or over the retaining member 109 but the wire can be drawn through the retaining member 109 with the application of a drawing force.

In the shown embodiment, the retaining member 109 is secured to the vertical portion 107 of the lid 100 so that the end of the wire which is secured by the retaining member 109 is positioned out of the way of the pay out operation. In certain conditions of operation it is needed to keep the lid surface 101 as free from obstruction as possible and/or to prevent the wire being drawn out through the opening 105 from catching on the secured end of the wire. Thus, by placing the retaining member 109 on the vertical portion 107 this will prevent the secured wire end from interfering with a wire payout operation or otherwise interfering with an operation.

Of course, in other embodiments, the retaining member 109 can be secured at other locations on the lid 100 so as to allow for the desired operation.

In exemplary embodiments of the present invention, the retaining member 109 is secured to the vertical portion 107 such that each side of the retaining member 109 is contacting the vertical portion 107. For example, as shown in FIGS. 1 and 4, the retaining member 109 has two flat portions which contact the vertical portion 107 and a channel portion through which the wire passes and is secured. By having both sides (the shown flat portions) of the retaining member 109 secured to the lid 100 the wire is prevented from inadvertently being dislodged out from under the retaining portion 109. As stated above, the channel portion of the retaining member 109 has a shape which permits the wire to be drawn through when pulled but also of a shape that securedly holds a wire in place so that it can not easily fall out of the channel portion or be inadvertently drawn out. This aspect is advantageous as further explained below, when and end of the wire is secured to another end of a wire from a separate container.

In an exemplary embodiment of the present invention, the retaining member 109 is made of a material which is resistive to wear, such as metal or hard plastic.

As shown in the exemplary embodiment depicted in FIGS. 1, 2 and 4, the retaining member 109 is secured to the lid 100 with a fastener 111. The fastener 111 can be of a simply type fastener, such as a screw, bolt, rivet, spot weld, etc., so that the retaining member 109 is fixedly secured to the lid 100. However, in other exemplary embodiments, the fastener 111 is a pivoting type fastener that secures the retaining member 109 to the lid 100 as described above, but allows the retaining member 109 to rotate about the fastener 111. By allowing the retaining member 109 to rotate the wire can be rotated while in the channel, thus allowing the drawing of the wire through the channel to be more flexible depending on the drawing direction. Further, if it is desired to remove the wire from the retaining member 109 after the wire end has been secured to another wire end, then the retaining member 109 can be rotated to allow the wire to be removed from the channel of the retaining member 109 without having to remove the retaining member 109 from the lid 100.

In yet a further exemplary embodiment of the present invention, the retaining member 109 is secured to the lid 100 via a hinge type device, which also allows for the easy removal of the wire if needed. However, in such an embodiment the hinge device may be springed so that the tension of the spring maintains the retaining portion 109 against the lid 100 to keep the wire secured so that an appreciable force is required to hinge the retaining member 109 and release the wire from the channel portion.

It is contemplated that other embodiments of the retaining member 109 and fastener 111 can be employed without departing from the scope and spirit of the present invention.

Figure 5:
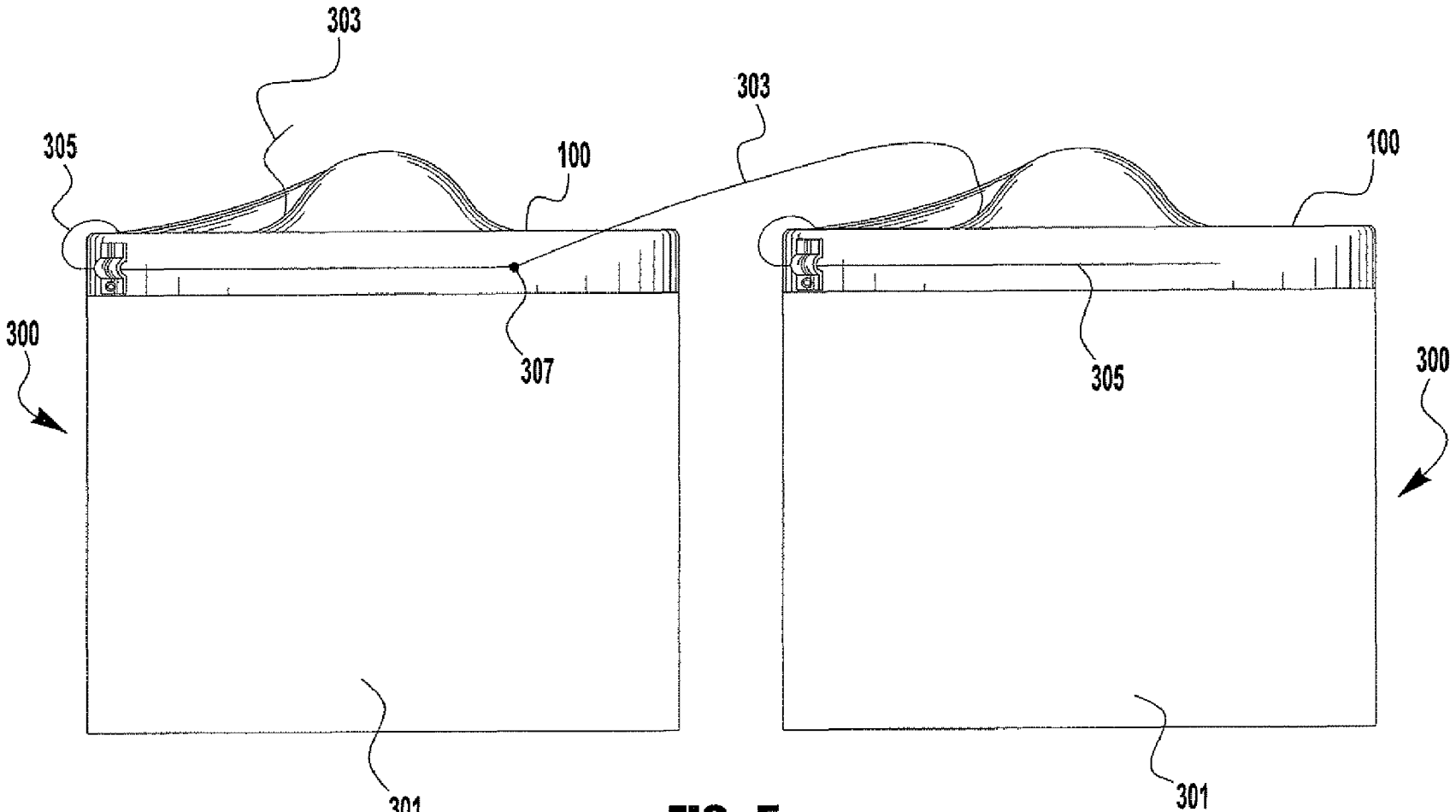
FIG. 5 is a diagrammatical representation of containers in accordance with an embodiment of the present invention.

Turning now to FIG. 5, two containers 300 in accordance with an exemplary embodiment of the present invention are shown. Each container 300 has a lid 100 as described above and a base portion 301. Within the base portion 301 can be a large bundle or coil of wire, including lengths up to 500 ft, for example. The lid 100 can be fixedly secured to the base portion 301 or can be merely placed over top of the base portion 301. Further, it is contemplated that the lid 100 is a reusable lid such that it can be repeatedly removed and placed on different base portions 301 to allow for repeated uses.

As shown in FIG. 5, the wire bundles have a leading end 303 and a trailing end 305. The leading end 303 of the wire is the end which is first drawn out to go to the welding operation, or otherwise be consumed, while the trailing end 305 is secured to the lid 100 via the retaining member 109. As described above, the trailing end 305 is secured such that it can not slip out of the retaining member 109 but can be passed or drawn between the retaining member 109 and the lid 100, such as by a drawing force.

Both the trailing end 305 and the leading end 303 of the wire come out of the opening 105 in the lid 100.

To make an effective "endless" welding operation, where even though the wire bundle in one container 300 is depleted the welding operation can continue without interruption, the wire from one container 300 is coupled to the wire from a separate container 300 as shown. That is the trailing end 305 of the wire in a first container 300 is secured, often by welding, to the leading end 303 of the wire from a second container 300. This is shown in FIG. 5 at the point 307 where the training end 305 of the first container is secured to the leading end 303 of the second container 300. Therefore, as the wire in the first container 300 is depleted the trailing end 305 then draws the leading end 303 of the wire in the next container 300.

Because of the configuration of the retaining member 109, as described above, the wire can be continuously drawn through the retaining member without interruption of the welding operation. Additionally, depending on the fastening methodology used for the retaining member 109 the wire can be released from the retaining member 109 without interruption of the drawing operation, thus allowing the lid 100 and/or container 300 to be removed and replaced with a new container 300, with a full wire bundle, thus allowing the wire drawing to go on indefinitely.

Of course, although the present invention has been discussed with respect to welding wire coils, it is contemplated that the present invention may be used in any applications where a material is coiled and is to be drawn or paid out in a smooth and efficient manner.

The present invention has been described with certain embodiments and applications. These can be combined and interchanged without departing from the scope of the invention as defined in the appended claims. The invention, as defined in these appended claims, are incorporated by reference herein as if part of the description of the novel features of the present invention.

We claim:

1. A welding wire container lid, said lid comprising:

a surface portion defining a shape to match a container so that the lid can be secured to the container;

a rim portion extending downward from said surface portion;

a protrusion portion extending upward from said surface portion in a direction opposite said rim portion; and an opening which is elongated in a direction extending from said protrusion portion onto said surface portion toward said rim portion, said opening having a first end disposed on said protrusion portion and a second end disposed on said surface portion spaced apart from said first end in the direction of elongation, said opening further having a first longitudinal side and a second longitudinal side spaced apart across said opening, each of said first and said second longitudinal sides extending from said first end to said second end, wherein said first longitudinal side has a first contour and said second longitudinal side has a second contour which is different from said first contour, such that at least a portion of said second longitudinal side is offset in a vertical direction relative to an adjacent portion of said first longitudinal side positioned across said opening from said portion of said second longitudinal side.

2. The welding container lid according to claim 1, wherein said second contour of said second side extends upward from said surface portion.

3. The welding container lid according to claim 2, wherein said second contour of said second side has a concave shape.

4. The welding container lid according to claim 1, further comprising a retaining member secured to said lid to retain a welding wire to said lid.

5. The welding container lid according to claim 4, wherein said retaining member has two side portions and a channel portion and each of said two side portions contact said lid.

6. The welding container lid according to claim 4, wherein said retaining member is pivotably secured to said lid so as to allow said retaining member to pivot.

7. The welding container lid according to claim 4, wherein said retaining member is secured to said rim portion of said lid.

8. The welding container lid according to claim 4, wherein said retaining member is secured to said lid via a hinge.

9. A welding wire container, said container comprising:

a base portion; and a lid, wherein said lid comprises:

a surface portion defining a shape to match the base portion so that the lid can be secured to the base portion;

a rim portion extending downward from said surface portion;

a protrusion portion extending upward from said surface portion in a direction opposite said rim portion; and an opening which is elongated in a direction extending from said protrusion portion onto said surface portion toward said rim portion, said opening having a first end disposed on said protrusion portion and a second end disposed on said surface portion spaced apart from said first end in the direction of elongation, said opening further having a first longitudinal side and a second longitudinal side spaced apart across said opening, each of said first and said second longitudinal sides extending from said first end to said second end, wherein said first longitudinal side has a first contour and said second longitudinal side has a second contour which is different from said first contour, such that at least a portion of said second longitudinal side is offset in a vertical direction relative to an adjacent portion of said first longitudinal side positioned across said opening from said portion of said second longitudinal side.

10. The welding container according to claim 9, wherein said second contour of said second side extends upward from said surface portion.

11. The welding container lid according to claim 10, wherein said second contour of said second side has a concave shape.

12. The welding container lid according to claim 9, further comprising a retaining member secured to said lid to retain a welding wire to said lid.

13. The welding container lid according to claim 12, wherein said retaining member has two side portions and a channel portion and each of said two side portions contact said lid.

14. The welding container lid according to claim 12, wherein said retaining member is pivotably secured to said lid so as to allow said retaining member to pivot.

15. The welding container lid according to claim 12, wherein said retaining member is secured to said rim portion of said lid.

16. The welding container lid according to claim 12, wherein said retaining member is secured to said lid via a hinge.

17. A welding wire container lid, said lid comprising:

a surface portion defining a shape to match a container so that the lid can be secured to the container;

a rim portion extending downward from said surface portion;

a protrusion portion extending upward from said surface portion in a direction opposite said rim portion; and a retaining member secured to said lid to retain a welding wire to said lid, where said retaining member has two side portions and a channel portion and each of said two side portions contact said lid; and an opening which is elongated in a direction extending from said protrusion portion onto said surface portion toward said rim portion, said opening having a first end disposed on said protrusion portion and a second end disposed on said surface portion spaced apart from said first end in the direction of elongation, said opening further having a first longitudinal side and a second longitudinal side spaced apart across said opening, each of said first and said second longitudinal sides extending from said first end to said second end wherein said first longitudinal side has a first contour and said second longitudinal side has a second contour which is different from said first contour, such that at least a portion of said second longitudinal side is deflected in a vertical direction relative to an adjacent portion of said first longitudinal side positioned across said opening from said portion of said second longitudinal side.

18. The welding wire container lid according to claim 17, wherein one of said first and second contours follows a contour of said surface portion and said protrusion portion.

19. The welding wire container lid according to claim 17, wherein one of said first and second contours extends upward from said surface portion.

* * * * *